US005198276A

United States Patent [19]

Nakajima

[11] Patent Number: 5,198,276

[45] Date of Patent: Mar. 30, 1993

[54] PAPER PRODUCTS HAVING PERFORATIONS AND PERFORATE PATTERN

[76] Inventor: Fujio Nakajima, Hosoi Mansion 303, 26-15, Ogikubo 2 chome, Suginami-ku, Tokyo 167, Japan

[21] Appl. No.: 837,834

[22] Filed: Feb. 14, 1992

[30] Foreign Application Priority Data

Feb. 15, 1991 [JP] Japan ..... 3-032927[U]

[51] Int. Cl.[5] ..... B32B 3/10

[52] U.S. Cl. ..... 428/43; 428/136

[58] Field of Search ..... 428/43, 136; 383/207; 493/930; 229/313

[56] References Cited

U.S. PATENT DOCUMENTS 2,266,958 12/1941 Corbin ..... 428/43

2,967,010 1/1961 Cuffey et al. ..... 428/43

3,227,359 1/1966 Hanlon ..... 383/207

*Primary Examiner*—Alexander S. Thomas

*Attorney, Agent, or Firm*—Anderson Kill Olick & Oshinsky

[57] ABSTRACT

Paper products having perforations and perforate pattern for use in a blank of paper or synthetic paper and an envelope, or the like.

The paper products comprises a paper, a vertical notch provided at upper end portion of the paper, and a plurality of Y shaped notches, which are provided in such a manner that first Y shaped notches have three notches, upper ends of upper opened two notches are positioned at the lower end of the notch on a horizontal line, and upper ends of upper opened two notches of second Y shaped notches are positioned at the lower end of the notch on a horizontal line, and so on until a lower end portion of the paper.

1 Claim, 4 Drawing Sheets

PAPER PRODUCTS HAVING PERFORATIONS AND PERFORATE PATTERN

FIELD OF THE INVENTION

The present invention relates to paper products having perforations and perforate patterns.

BACKGROUND OF THE INVENTION

Paper products means a blank of paper or synthetic paper and pouches such as envelopes made of such a paper or synthetic paper.

Generally perforations made on a paper are separated; in order to finely separate these perforations, user first makes a fold on the paper by folding along the perforations. Then the edge portion of the perforations is separated by fingers of hands by about 1 cm, and finally, as shown in FIG. 8, both side portions of the perforations are held between forefinger and thumb of each finger of hands to twist the paper, thereby separating it into two parts.

The above separating process can not obtain a rapid separating operation and causes large, troublesome time loss. Moreover, with such a separating process, distribution to force caused by fingers of hands becomes uneven so that paper is separated in the oblique direction which deviates from perforations, thereby damaging a content printed on the paper or a content enclosed in an envelope formed by such a paper.

SUMMARY OF THE INVENTION

It is an object of the present invention to overcome the above disadvantages of conventional paper products.

It is another object of the present invention to provide economical products having perforations and perforate pattern.

According to the present invention, there are provided paper products in which the above step of folding the perforations and the step of holding both side portions of the perforations between forefinger and thumb of respective fingers are omitted, thereby increasing workability; and the perforations of the paper can be separated.

According to the present invention, there are provided paper products having perforations and perforate, pattern comprises a paper E, a vertical notch d provided at upper end portion of the paper, and a plurality of Y shaped notches, which are provided in such a manner that first Y shaped notches have three notches a, b and c, upper ends of upper-opened two notches a and b are positioned at the lower end of the notch d on a horizontal line x, and upper ends of upper-opened two notches a' and b' of second Y shaped notches are positioned at the lower end of the notch c' on a horizontal line, and so on until a lower end portion of the paper.

Another embodiment of the present invention is paper products having perforations and perforate patterns comprising a paper E, notch e obliquely provided at upper end portion of the paper, a plurality of notches i, m, q, . . . provided downwards in parallel to the notch e with a given distance, and a plurality of notches h, l, p, . . . provided in oppositely oblique so as to interest an extension line of respective notches e, i, m, q, . . . at the center portion thereof, respectively, and so on, which are provided in such a manner that respective lower ends of the notches e, i, m, q, . . . and respective upper ends of the notches h, l, p, . . . are positioned on a horizontal line, and, perforations g, f, k, j, o, n, . . . are formed on respective extension lines of the notches e, i, m, . . . and between the lower end of first notch e and the upper end of following notches i, m, q, . . . .

Other embodiments of the present invention, paper products having perforations and perforate patterns comprises a paper E, a notch e obliquely provided at upper end portion of the paper, a plurality of first notches i, m, q, . . . provided downwards parallel to the notch e with a given distance, and a plurality of notches h, l, p, . . . provided oppositely oblique so as to intersect an extension line of respective notches e, i, m, q, . . . at the center portion thereof, respectively, and so on, which are provided in such a manner that respective lower ends of the notches e, i, m, q, . . . and respective upper ends of the notches h, l, p, . . . are positioned on a horizontal line, and a plurality of third notches e', i' m' q' . . . are provided parallel to the notches e, i, m, q, . . . through respective notches h, l, p, . . . .

Preferred embodiment of the present invention, paper products having perforations and perforate pattern as claimed in claim 4, wherein a notch width w between respective notches e, i, m, q, . . . and respective notches e', i', m', q', . . . is increased in comparison to only the width of respective notches e, i, m, q, . . . : e', i', m', q', . . . .

Further embodiment of the present invention, paper products having perforations and perforate pattern comprises a paper E, a notch e obliquely provided at upper end portion of the paper, a vertical notch d provided at lower end of the oblique notch e with a given distance, next notch e' obliquely provided opposite to the oblique notch e and so as to position its upper end on lower end of the notch d in the horizontal position, and next vertical notch d' provided at lower end of the oblique notch e' with a given distance, and so on.

DETAILED EXPLANATION OF THE PREFERRED EMBODIMENT

Figure 1:
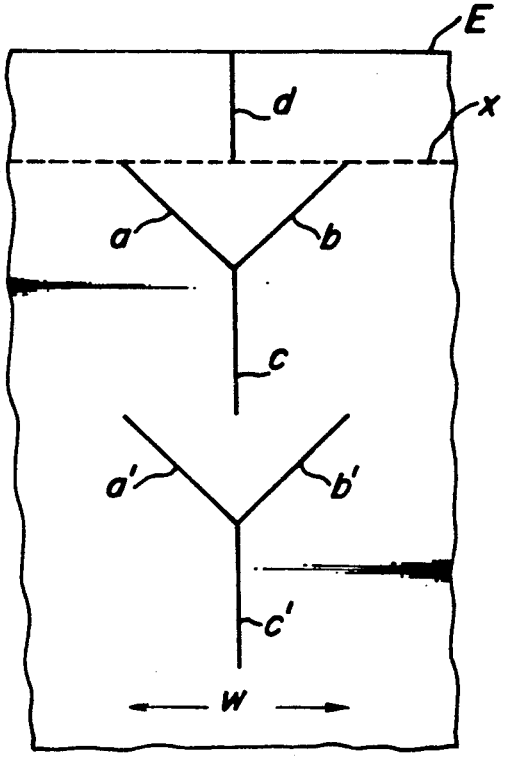
FIG. 1 is a plan view showing a perforate pattern formed on a paper used in a basic embodiment of the present invention.

Referring now to the drawings, there are shown perforations or perforate pattern provided on a paper according to the present invention.

FIG. 1 shows a perforate pattern provided on a paper used in a basic embodiment, and FIGS. 2 to 5 show perforated patterns provided on a paper used in several embodiments according to the present invention, respectively. In FIGS. 1 to 5, like reference characters designate like or corresponding parts throughout. In FIG. 1, E is a blank of a paper or a synthetic paper or pouches such as envelope (hereinafter, referred to as a paper), d is a straight perforation or notch formed at right angles to an end of the paper E, and a, b and c are three perforations or notches provided in a form of Y. Respective notches are arranged at an angle of almost 120° with each other, and upper ends of upper opened two notches a and b are positioned at and in contact with a dotted line x which designates a horizontal position at the lower end of the notch d. Similar to the above situation Y shaped notches a', b' and c' are also so arranged that the upper ends of the notches a' and b' are positioned at the lower end of the notch c. These Y shaped notches are continuously provided in series downwardly until another end of the paper E.

It is found from experiment that the angle between two notches a and b is an order of 90° to 160°, practically, and the length of the notch d may be determined in accordance with the quality of paper and this notch d is indispensable. Respective notches a, b, c and d have respective lengths depending on the thickness of paper, the equality of material and the length of fiber. Generally, the more the thickness of the paper, the more the unequality of material, and the more the length of fiber, the more the length of notches. For example, in the case of an envelope having the thickness of about 0.1 mm, the length of notches was an order of 0.1~1.5 mm and the width w of notches was an order of 1.5~2.0 mm. In this case, it is preferable that for the paper having surface layer being liable to be peeled off, the length of both notches a and b must be more long and for the tracing paper being liable to be hard peeled off, the length of the notches a and b must be shorter.

According to the construction of the paper products shown in FIG. 1, firstly, since the edge portion of the paper E is provided with the notch d, both sides of the notch d of the paper E are held between fingers of hands and cut by adding a twisting force, so that the paper E was easily separated away from each other. Then, since notches a and b are provided at both sides of the lower end portion of the notch in the horizontal direction, when the paper E is torn continuously (even through the rip of paper is out of the perforations in the oblique direction due to unequality of material of the paper E) the rip reaches either one of these notches a and b, and then reaches along either one of notches a and b lower end portion of a vertical notch c from the upper end portion thereof. Then, the rip of the paper E proceeded to shape notches a' and b' and c' as in the same manner as the above process, and to next Y shaped notches, and so on until the other end portion of the paper E along the perforations. According to this separation process, the rip is not deviated from the perforations towards right or left at all and the separation of the paper can easily be performed, so that the separating time can be decreased substantially. For example, the conventional separating time took about 15 seconds and the separating time according to the present invention took only about 5 seconds. Moreover, the separation of the paper can be surely and simply performed, so that the paper products according to the present invention can easily be utilized by anyone, such as a small child, a child, an old man and an lungler of finger.

Figure 2:
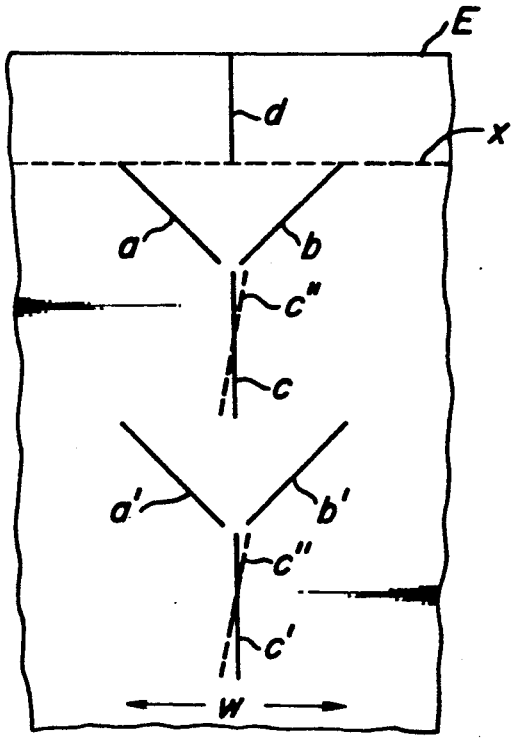
FIG. 2 is a plan view showing a perforate pattern according to a preferred embodiment of the present invention.

FIG. 2 shows a modification of the paper products having perforate pattern shown in FIG. 1. In this embodiment, the Y shaped notch pattern has a disconnected center portion. That is, one end portion each of respective notches a, b and c are separated from each other at the center portion of the Y shaped notch pattern. Other portions of the Y shaped notch of perforate pattern is the same as that of the Y shaped notch of the perforate pattern shown in FIG. 1, so that the construction and the operation thereof are omitted.

Moreover, the notch c can be slanted as shown in FIG. 2 by a dotted line c''.

According to the construction of perforation shown in FIG. 2, a gap is formed at the center portion of the Y shaped notches a, b and c, so that the "hang-nail" caused at the center portion of the Y shaped notch pattern can be prevented. Moreover, as shown in FIG. 2 by the character c'', when the vertical notch c'' is made slightly oblique, the rip downwards to lower notch a' becomes short, so that the separating operation becomes simple and raped.

Figure 3:
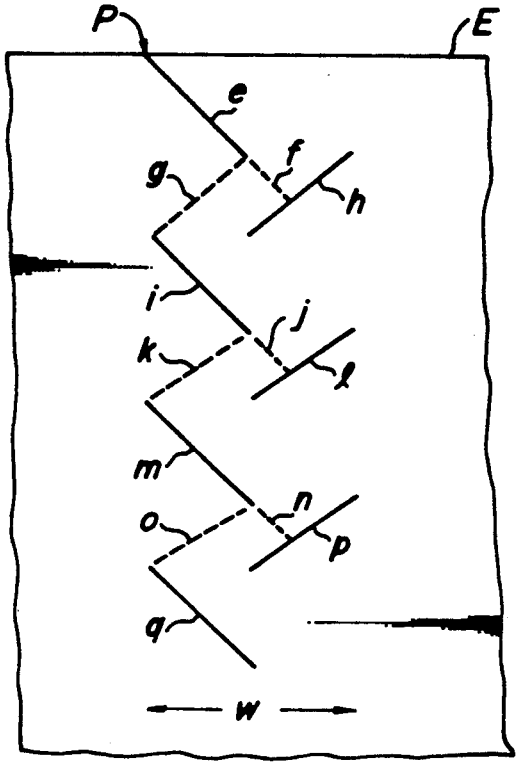
FIG. 3 is a plan view showing a perforate pattern according to another embodiment of the present invention.

FIG. 3 shows another embodiment of the paper products having perforations or perforate pattern according to the present invention. In this embodiment, an oblique notch e is provided at upper end of a paper E, and a notch h is obliquely provided opposite to the notch e so as to intersect an extension line of the oblique notch e at the center portion of the notch h. Lower end of the notch e and upper end of the notch h are positioned on a horizontal line. Next oblique notch i is provided so as to position its upper end and lower end of the notch h. The set of notches e, h and i is repeatedly and continuously provided until lower end portion of the paper E. In this case, the lower end of the first notch and the upper end of the second notch are positioned on a horizontal line, and so on.

A dotted line f formed as an extension of the notch e is made in the form of perforations, and a dotted line g is provided between the lower end of the notch e and the upper end of the notch i and is made in the form of perforations. The provision of the perforations g and f limit a ripping direction at the lower end of the notch e and prevent a generation of an the rip in abnormal direction which cause in the direction of fiber of paper and not intended. These perforations f, g, j, k, . . . are not always necessary and can be omitted. First separation starting of the paper begin at a point P or a slightly right portion of the point P.

FIG. 3 shows one embodiment of the oblique angle of the first notch e, but this oblique angle may be optionally determined by the paper quality. If this oblique angle is made small the paper can easily be separated with weak force even if it is strong paper.

Figure 4:
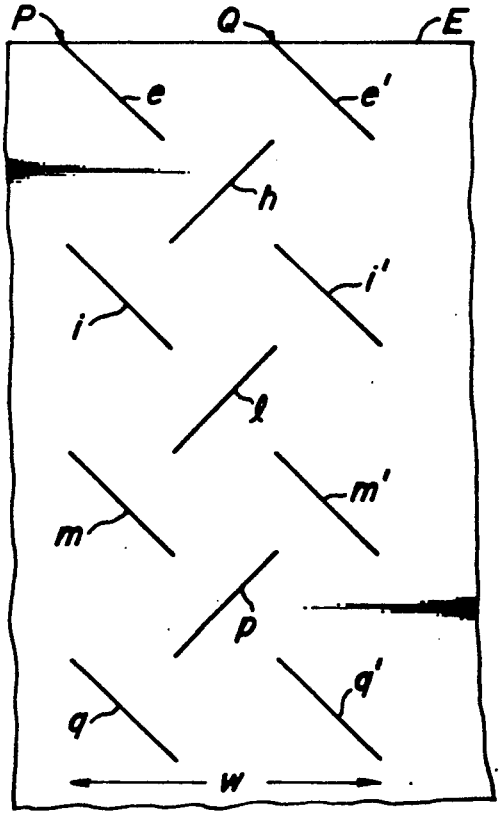
FIG. 4 is a plan view showing a perforate pattern according to other embodiment of the present invention.

FIG. 4 shows a further embodiment of paper products according to the present invention. In this embodiment, a series of notches e, i, m, q . . . and h, l, p, . . . shown in FIG. 3 is provided, and a plurality of notches e', i', m', q', . . . is added thereto in such a manner that the notches e', i', m', q', . . . are positioned at right angles to the notches h, l, p, . . . and in parallel to the notches e, i, m, q, . . . The provision of such a patterned notch can tear a thick and firm paper within the width w of the pattern. In this case, respective lower ends of the notches e, e' and the upper end of the notch h are positioned on a horizontal line, and the lower end of the notch h and the upper ends of next notches i, i' are positioned on a horizontal line, and so on. The other portions of the notch pattern are the same as those of the notch pattern shown in FIG. 3.

According to the above construction, first separation starting position are made points P and Q, so that separation of the paper can easily be performed and started from the upper end of the lower end of the paper. If the width of pattern is wide, the thick paper material can also be performed easily.

Figure 5:
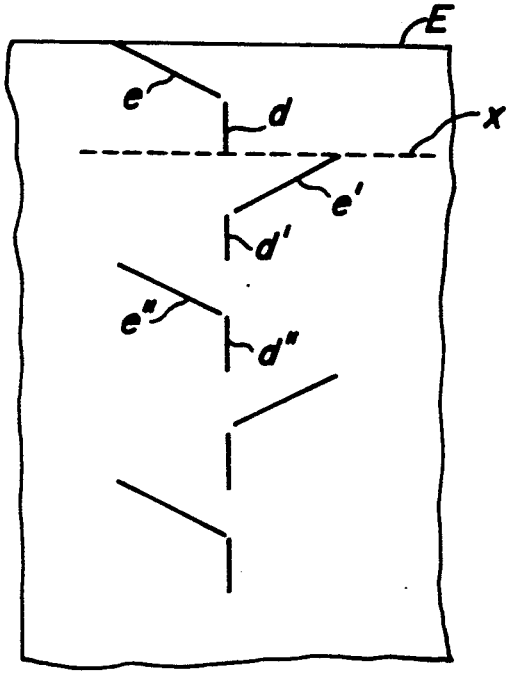
FIG. 5 is a plan view showing a perforate pattern according to further embodiment of the present invention.
Figure 6:
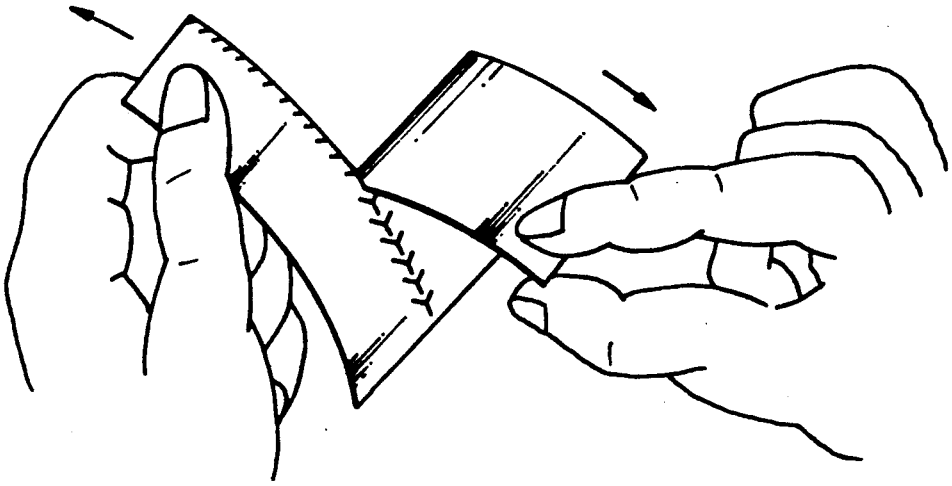
FIG. 6 is a perspective view showing a utilizing status of the perforations provided on the paper shown in FIG. 1.
Figure 7:
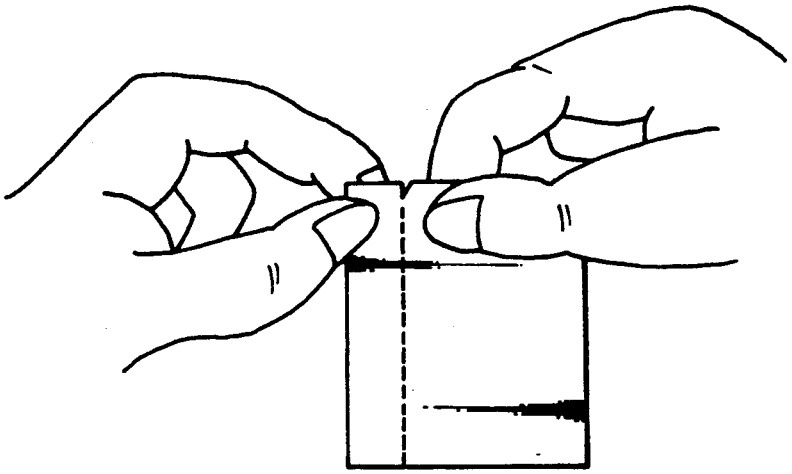
FIGS. 7 and 8 are perspective views showing utilizing status of perforations provided on the conventional paper products.
Figure 8:
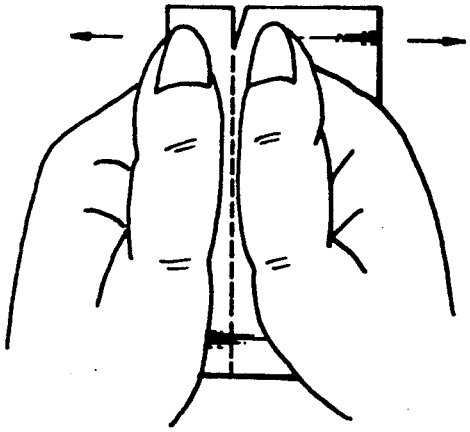

FIG. 5 shows a further embodiment of the notch pattern according to the present invention. In this embodiment, the paper products comprise a paper E, a notch e obliquely provided at upper end portion of the paper, a vertical notch d provided at lower end of the oblique notch e with a given distance, next notch e' obliquely provided opposite to the oblique notch e, and so as to position its upper end on lower end of the notch d in the horizontal position, and next vertical notch d' provided at lower end of the oblique notch e' with a given distance, and so on. Provision of such a construction can make a fold in the direction of the notches d, d' and d'' and the oblique angle of the notches e, e' and e'' can be determined in dependent with the paper quality and the thickness of the paper to be used.

According to such a construction, the generation of "hand-nail" can be prevented.

As described above, the provision of a notch pattern according to the present invention can decrease the separating operation time, so that the separation of a blank of paper, envelope and a supply specification which is treated by a computer.

While the preferred and alternate embodiments of the invention have been described in detail, modifications and adaptations thereto may be made without departing from the spirit and scope of the invention as recited in the following claims:

What is claimed is:

1. Paper products having perforations and perforate pattern, comprising;

a paper surface;

an initial first notch obliquely provided at upper an end portion of the paper surface;

a plurality of first subsequent notches substantially parallel to the initial first notch, each of said first notches at an approximately given distance from its adjacent first notch;

a plurality of second notches in an orientation oppositely oblique to orientation of said first notches so as to intersect an extension line of said respective first notches at substantially the center portion of said second notches wherein a respective lower end of any of the first notches and the upper ends of an adjacent second notch are positioned on a horizontal line;

first perforations on the respective extension lines of the first notches (e, i, m, . . . ); and second perforations between the lower end of any of the first notches and the upper end of the next adjacent one of the following first notches.

* * * * *